US005996547A

United States Patent [19]

Machida et al.

[11] Patent Number: 5,996,547

[45] Date of Patent: Dec. 7, 1999

[54] CONTROL APPARATUS FOR DIRECT INJECTION SPARK IGNITION TYPE INTERNAL COMBUSTION ENGINE

[75] Inventors: Kenichi Machida, Atsugi; Kenichi Gotoh; Hideyuki Tamura, both of Yokohama, all of Japan

[73] Assignee: Unisia Jecs Corporation, Atsugi, Japan

[21] Appl. No.: 09/106,264

[22] Filed: Jun. 29, 1998

[30] Foreign Application Priority Data

Jun. 30, 1997 [JP] Japan ..... 9-173942

[51] Int. Cl.[6] ..... F02B 17/00

[52] U.S. Cl. ..... 123/295; 123/305; 123/350

[58] Field of Search ..... 123/295, 305, 123/350

[56] References Cited

U.S. PATENT DOCUMENTS

| | | | |
|---|---|---|---|
| 4,853,720 | 8/1989 | Onari et al. | 123/350 |
| 4,971,011 | 11/1990 | Nanyoshi et al. | 123/350 |
| 5,069,181 | 12/1991 | Togai et al. | 123/350 |
| 5,078,109 | 1/1992 | Yoshida et al. | 123/350 |
| 5,660,157 | 8/1997 | Minowa et al. | 123/350 |
| 5,722,362 | 3/1998 | Takano et al. | 123/295 |
| 5,755,198 | 5/1998 | Grob et al. | 123/295 |
| 5,785,031 | 7/1998 | Akimoto et al. | 123/295 |
| 5,789,367 | 8/1998 | Iida et al. | 123/295 |

*Primary Examiner*—John Kwon
*Attorney, Agent, or Firm*—Foley & Lardner

[57] ABSTRACT

The present invention aims at preventing deterioration of driveability due to lean combustion, in a direct injection spark ignition type internal combustion engine. To this end, there is calculated a target engine-torque tTe which is to be generated by the engine, based on an engine driving condition, while detecting an actual engine-torque Te which is being actually generated by the engine. There is further calculated a deviation state quantity ΔTQ=Te−tTe, which represents a deviation state between the target engine-torque and the actual engine-torque. Then, the lean combustion is inhibited when the deviation state quantity ΔTQ is equal to or larger than a predetermined value. Namely, homogeneous lean combustion and stratified lean combustion are inhibited, and the combustion mode is switched to homogeneous stoichiometric combustion.

8 Claims, 8 Drawing Sheets

CONTROL APPARATUS FOR DIRECT INJECTION SPARK IGNITION TYPE INTERNAL COMBUSTION ENGINE

TECHNICAL FIELD

The present invention relates to a control apparatus for a direct injection spark ignition type internal combustion engine, and particularly to a control apparatus for a direct injection spark ignition type internal combustion engine in which a combustion mode is switchingly controlled at least between: stoichiometric combustion at a stoichiometric air-fuel ratio (theoretical air-fuel ratio); and lean combustion at lean air-fuel ratio (leaner side than the theoretical air-fuel ratio); corresponding to an engine driving condition.

BACKGROUND ART

Recently, attention has been directed to a direct injection spark ignition type internal combustion engine in which fuel is directly injected into a combustion chamber of the engine. In this type of engine, the combustion mode is switchingly controlled corresponding to an engine driving condition, i.e., the combustion mode is switchingly controlled between stoichiometric combustion (sioichiometric homogeneous combustion) and lean combustion (stratified lean combustion or homogeneous lean combustion) (see Japanese Unexamined Patent Publication No. 59-37236).

However, in a direct injection spark ignition type internal combustion engine, fuel is directly injected into a combustion chamber of the engine, so that the torque sensitivity of a fuel system is increased (i.e., torque does turn out to vary by a large amount even with a slight change of fuel injection amount). Thus, if the amount of fuel injection is instantaneously increased such as due to trouble of fuel system part, there may be caused an abrupt change of behavior of the vehicle, resulting in deterioration of driveability.

The present invention has been carried out in view of the conventional problems as described above, and it is therefore an object of the present invention to avoid deterioration of driveability such as due to trouble of fuel system part.

DISCLOSURE OF THE INVENTION

Thus, the present invention provides a control apparatus for a direct injection spark ignition type internal combustion engine, including: a fuel injection valve for directly injecting fuel into a combustion chamber of the engine; and a combustion mode switching control device for switchingly controlling a combustion mode of the engine at least between stoichiometric combustion at stoichiometric air-fuel ratio and lean combustion at lean air-fuel ratio, corresponding to an engine driving condition, the apparatus comprising: a target engine-torque calculating device for calculating a target engine-torque which is to be generated by the engine, based on the engine driving condition; an actual engine-torque detecting device for detecting an actual engine-torque which is being actually generated by the engine; a deviation state quantity calculating device for calculating a deviation state quantity which represents a deviation state between the target engine-torque and the actual engine-torque; and a lean combustion inhibition device for inhibiting the lean combustion when the deviation state quantity is equal to or larger than a predetermined value.

According to such a constitution, there is calculated the target engine-torque which is to be generated by the engine, and there is detected the actual engine-torque which is being actually generated by the engine. When the deviation state quantity between the target engine-torque and the actual engine-torque is larger, there is a possibility of driveability deterioration, so that the lean combustion is inhibited to thereby prevent deterioration of driveability due to lean combustion.

Preferably, the target engine-torque calculating device calculates the target engine-torque, based on an engine rotation speed and an opening degree of accelerator.

Further, the actual engine-torque detecting device may calculate the actual engine-torque; based on a rotational angular acceleration (variation of rotational angular speed) during a combustion stroke of the engine, or based on a combustion pressure of the engine.

Further, if the deviation state quantity calculating device calculates the deviation state quantity, as a difference between the target engine-torque and the actual engine-torque, the deviation state can be easily quantified.

The deviation state quantity calculating device can calculate the deviation state quantity, as a difference between a variation of the target engine-torque and a variation of the actual engine-torque. Thus, the influence, such as due to a machine variation and environment condition, can be canceled, thereby improving diagnosis precision.

In case that the combustion mode switching control device switchingly controls the combustion mode of the engine corresponding to the engine driving condition, at least between: homogeneous stoichiometric combustion at the stoichiometric air-fuel ratio in which fuel is injected during an intake stroke; homogeneous lean combustion at the lean air-fuel ratio in which fuel is injected during the intake stroke; and stratified lean combustion at the lean air-fuel ratio in which fuel is injected during a compression stroke; the lean combustion inhibition device inhibits the homogeneous lean combustion and the stratified lean combustion, when the deviation state quantity is equal to or larger than a predetermined value. Thus, deterioration of driveability can be assuredly prevented.

Further features and constitution, as well as operation and effects based thereon according to the present invention will become more apparent from the following description of preferred embodiments when read in conjunction with the accompanying drawings.

BEST MODE FOR CARRYING OUT THE INVENTION

Figure 1:
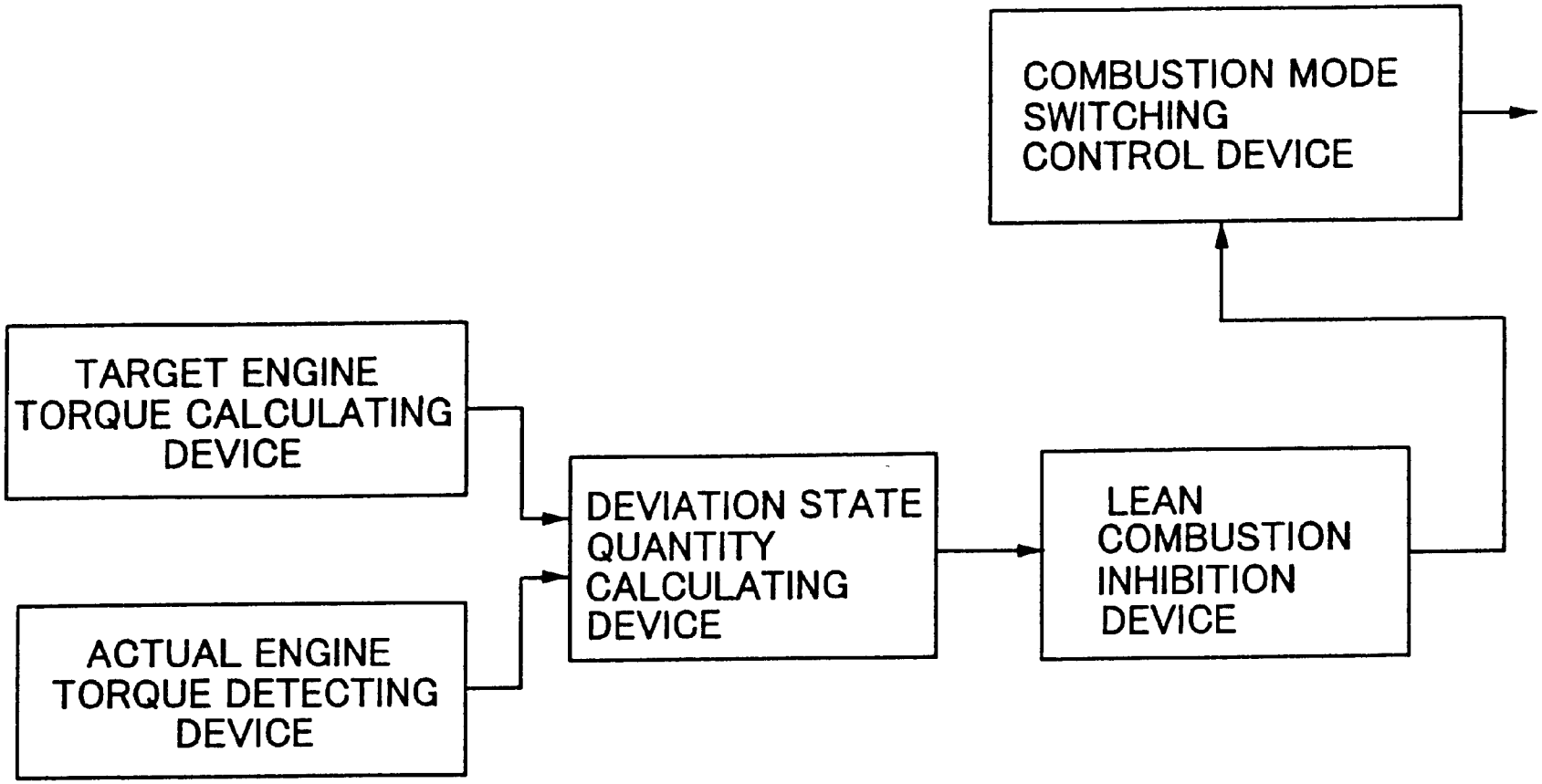
FIG. 1 is a functional block diagram showing a basic constitution of the present invention.

Shown in FIG. 1 is a basic constitution of a control apparatus for a direct injection spark ignition type internal combustion engine according to the present invention, and there will be hereinafter described the embodiments thereof with reference to FIGS. 2 through 8.

Figure 2:
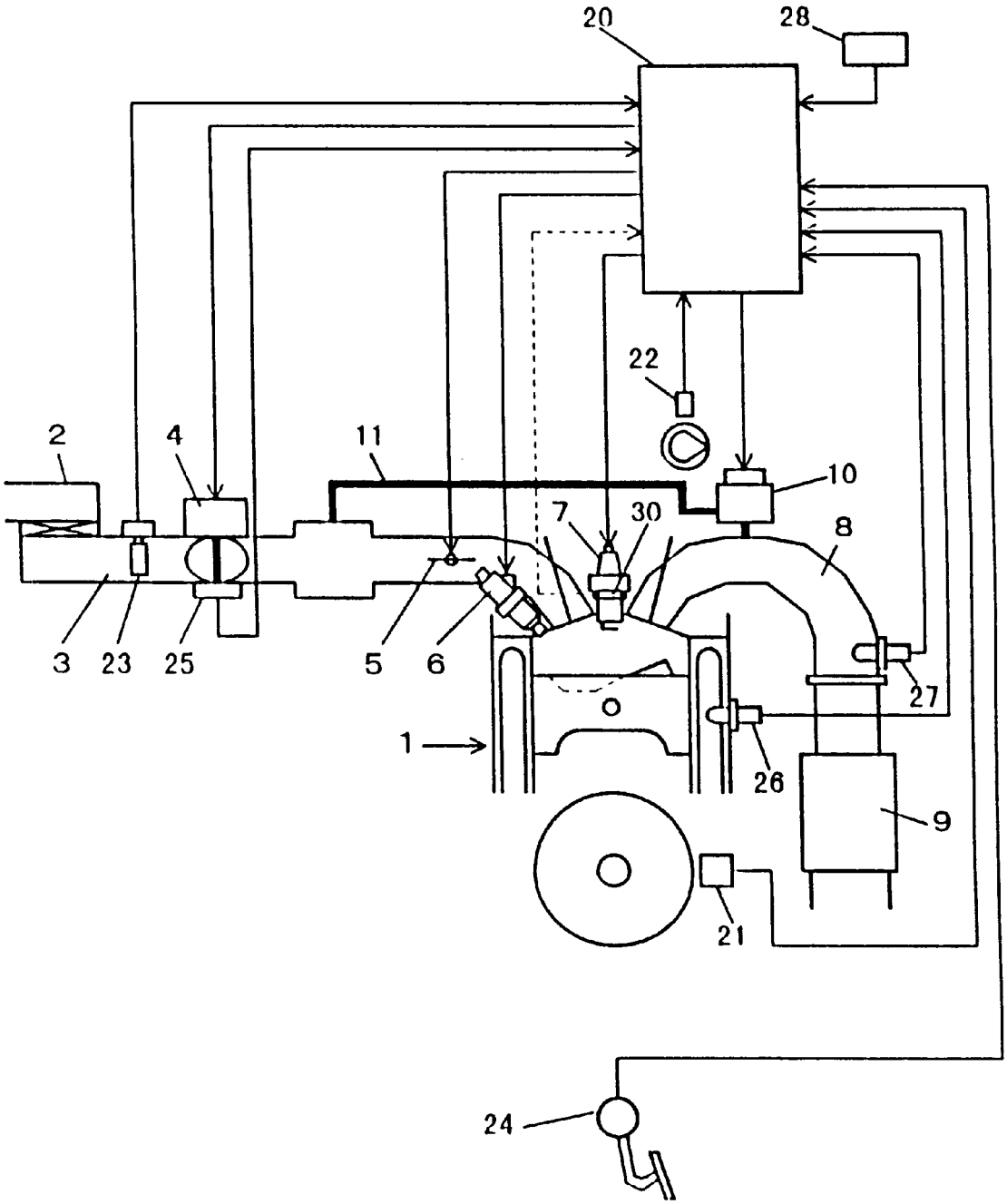
FIG. 2 is a systematic view of an internal combustion engine according to an embodiment of the present invention.

FIG. 2 is a systematic view of an internal combustion engine showing one embodiment of the present invention, which will be described first hereinafter.

Air is sucked into a combustion chamber of each of the cylinders of an internal combustion engine 1 mounted on a vehicle from an air cleaner 2 via an intake passage 3, under control of an electrically controlled throttle valve 4. There is also provided a swirl control valve 5, so as to control air flow to be sucked into the combustion chamber, by controlling a cross sectional area of port.

Also provided is an electromagnetic injection valve (injector) 6 for directly injecting fuel (gasoline) into the combustion chamber.

To inject fuel which is regulated to a predetermined pressure, the electromagnetic injection valve 6 is constituted to be opened by device of a solenoid which is energized by an injection pulse signal which is output by a control unit 20 to be described later at an intake stroke or a compression stroke in a manner synchronized with engine rotation. The injected fuel is diffused within the combustion chamber to thereby establish a homogeneous air-fuel mixture, in case of intake stroke injection; and in case of compression stroke injection, forms a stratified air-fuel mixture concentratedly about an ignition plug 7, and ignited by the plug 7 to be thereby burnt (homogeneous combustion or stratified combustion), based on an ignition signal from a control unit 20 to be described later. In the above, the combustion modes may be categorized into homogeneous stoichiometric combustion, homogeneous lean combustion, and stratified lean combustion, in combination with air-fuel ratio control.

An exhaust gas from the internal combustion engine 1 is exhausted via exhaust passage 8 which is provided with a catalytic converter 9 thereon for purifying the exhaust gas. A part of the exhaust gas is recirculated toward the downstream of the electrically controlled throttle valve 4 of the intake passage 3 (intake manifold), via an electrically controlled exhaust gas recirculation valve 10 and thereafter through an exhaust gas recirculation passage 11.

The control unit 20 is provided with a microcomputer which is constituted to include CPU, ROM, RAM, A/D converter, and I/O interface. This unit 20 receives input signals from various sensors, and performs calculation based thereon, to thereby control operations such as of electromagnetic injection valve 6 and ignition plug 7.

The various sensors mentioned above include crank angle sensors 21 and 22 for detecting rotation of a crankshaft and a camshaft of the internal combustion engine 1, respectively. Each of these crank angle sensors 21 and 22 is adapted to generate: a reference pulse signal REF at a previously set crank angle position (such as 110° before top dead center), at each of crank angle 720°/n, assuming the number of cylinders be "n"; and a unit pulse signal POS for each unit angle of from 1° to 2°, so that an engine rotation speed Ne can be calculated such as based on a period of the reference pulse signal REF. Particularly, the crank angle sensor 22 generates cylinder discrimination signals PHASE each of which corresponds to a specific cylinder, at previously set crank angles spanned by a crank angle of 720°, respectively, so that cylinder discrimination can be attained.

There are additionally provided such as, an air flow meter 23 for detecting an intake air flow quantity Qa at the upstream of the electrically controlled throttle valve 4 of the intake passage 3, an acceleration sensor 24 for detecting a stepped-forward degree of accelerator pedal (opening degree of accelerator) ACC, a throttle sensor 25 for detecting a throttle opening degree TVO of the electrically controlled throttle valve 4 (the throttle sensor 25 including an idle switch which is turned ON at a fully closed position of the throttle valve 4), a water temperature sensor 26 for detecting a temperature Tw of cooling water for the internal combustion engine 1, an oxygen sensor 27 for outputting a signal corresponding to a rich/lean state of an air-fuel ratio of exhaust gas within the exhaust passage 8, and a vehicle speed sensor 28 for detecting a vehicular speed VSP.

There will be described hereinafter the switching control of the combustion mode which is executed by the control unit 20, with reference to the flowcharts of FIGS. 3 through 7.

Figure 3:
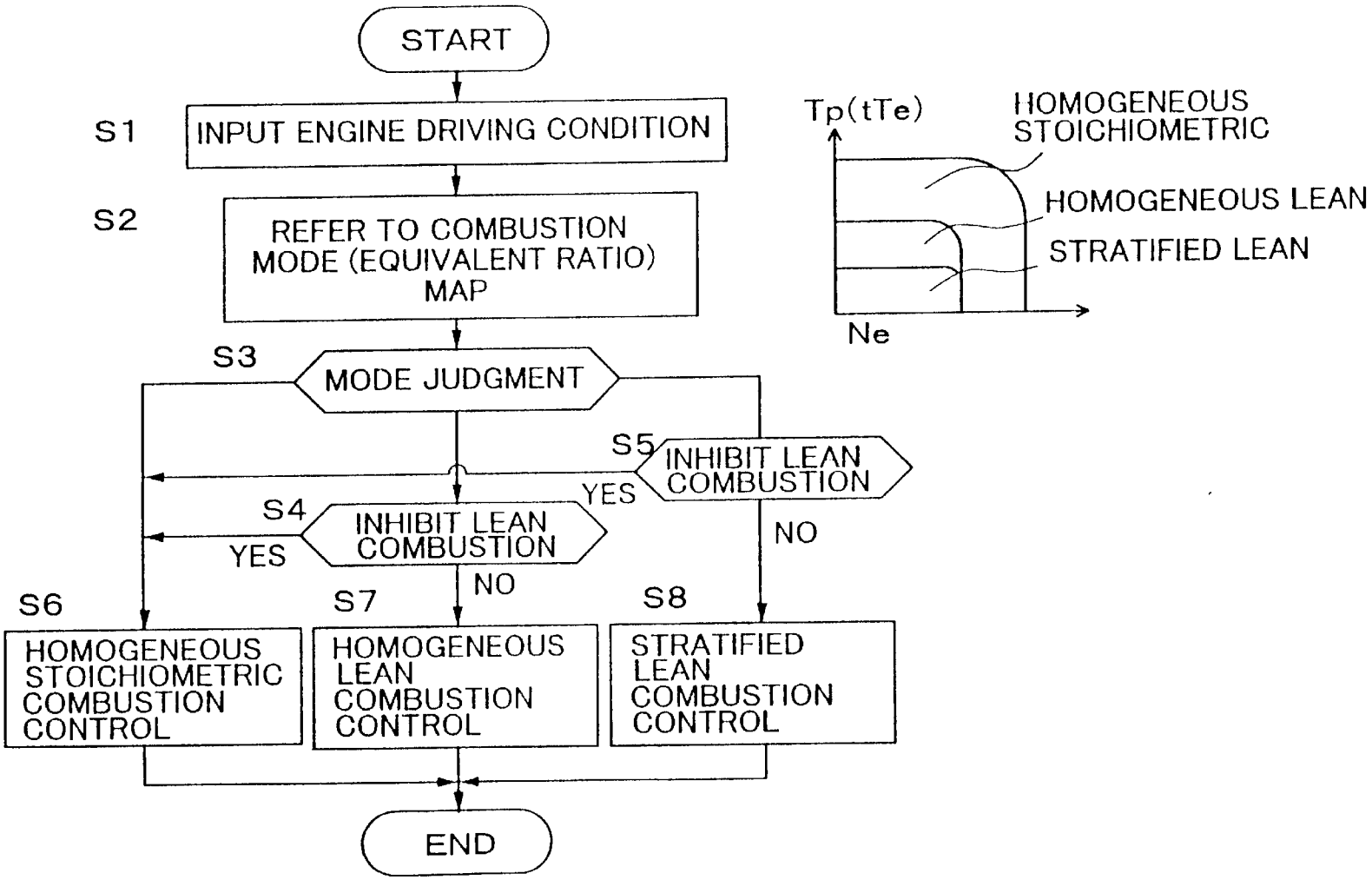
FIG. 3 is a flowchart of a routine for switching a combustion mode.

FIG. 3 shows a routine for switching a combustion mode, which routine is executed at intervals of a predetermined period of time (such as 10 ms). This routine corresponds to combustion mode switching control device.

At step 1 (referred to as S1; and the same rule applies correspondingly to the following), engine driving conditions such as engine rotation speed Ne, basic fuel injection amount Tp (or target engine-torque tTe), and cooling water temperature Tw are read in.

At step 2, there is referred to a combustion mode switching map, based on the engine driving conditions. Namely, there are provided a plurality of maps each of which determines the combustion modes (as well as basic target equivalent ratio TFBYAO) based on parameters of engine rotation speed Ne and basic fuel injection amount Tp, classified by conditions such as cooling water temperature Tw, and a period of time lapsed after engine starting. Determined from the map selected based on these conditions, is an appropriate one of the combustion modes (together with the basic target equivalent ratio TFBYAO), homogeneous stoichiometric combustion, homogeneous lean combustion, and stratified lean combustion, in accordance with parameters of the actual engine driving condition. The map exemplarily shown in FIG. 3 is provided for a condition after completion of warming up (cooling water temperature Tw is high, and the period of time after starting is sufficiently long).

At step 3, there is executed a judgment for the combustion mode, and the flow branches therefrom based on the judgment.

In case of homogeneous stoichiometric combustion, the flow goes to step 6, to conduct a due control. Namely, the amount of fuel injection is set to correspond to a stoichiometric air-fuel ratio (14.6), and there is executed an air-fuel ratio feedback control by the oxygen sensor 27, while the injection timing is set at the intake stroke, to thereby perform the homogeneous stoichiometric combustion.

In case of homogeneous lean combustion, the flow goes to step 7, to conduct a due control. Namely, the amount of fuel injection is set to correspond to a lean air-fuel ratio of from 20 to 30, and there is executed an open control, while the injection timing is set at the intake stroke, to thereby perform the homogeneous lean combustion.

In case of stratified lean combustion, the flow goes to step 8, to conduct a due control. Namely, the amount of fuel injection is set to correspond to a lean air-fuel ratio at approximately 40, and there is executed an open control, while the injection timing is set at the compression stroke, to thereby perform the stratified lean combustion.

It is noted that the steps 4 and 5 are provided just before the steps 7 and 8 for the homogeneous lean combustion control and for the stratified lean combustion control, respectively. It is judged at each of these steps 4 and 5, as to whether the lean combustion is to be inhibited or not (to thereby set a lean combustion inhibition flag to '1', if inhibited). In case of inhibition of lean combustion, the flow goes to step 6 to perform the homogeneous stoichiometric combustion control, without performing the homogeneous lean combustion control or stratified lean combustion control.

The equation for the amount of fuel injection is as follows:

$$TI=Tp\times TFBYA\times\alpha+Ts;$$

wherein Tp is the basic fuel injection amount which corresponds to the stoichiometric air-fuel ratio, and is obtained by an equation Tp=KO×Qa/Ne (KO: constant).

Further, TFBYA is a target equivalent ratio, which is obtained by such a processing that the basic target equivalent ratio TFBYAO obtained from the selected map is corrected such as based on an combustion efficiency; and added with a time-lag for first order. The target equivalent ratio TFBYA is also called "target air-fuel ratio correction coefficient" which is represented as 14.6/tAF, assuming the target air-fuel ratio be tAF.

Further, $\alpha$ is an air-fuel ratio feedback correction coefficient, based on the oxygen sensor signal, and is clamped at one (i.e., =1) at the lean combustion.

Ts is an invalid injection correction portion, which depends on a battery voltage.

Figure 4:
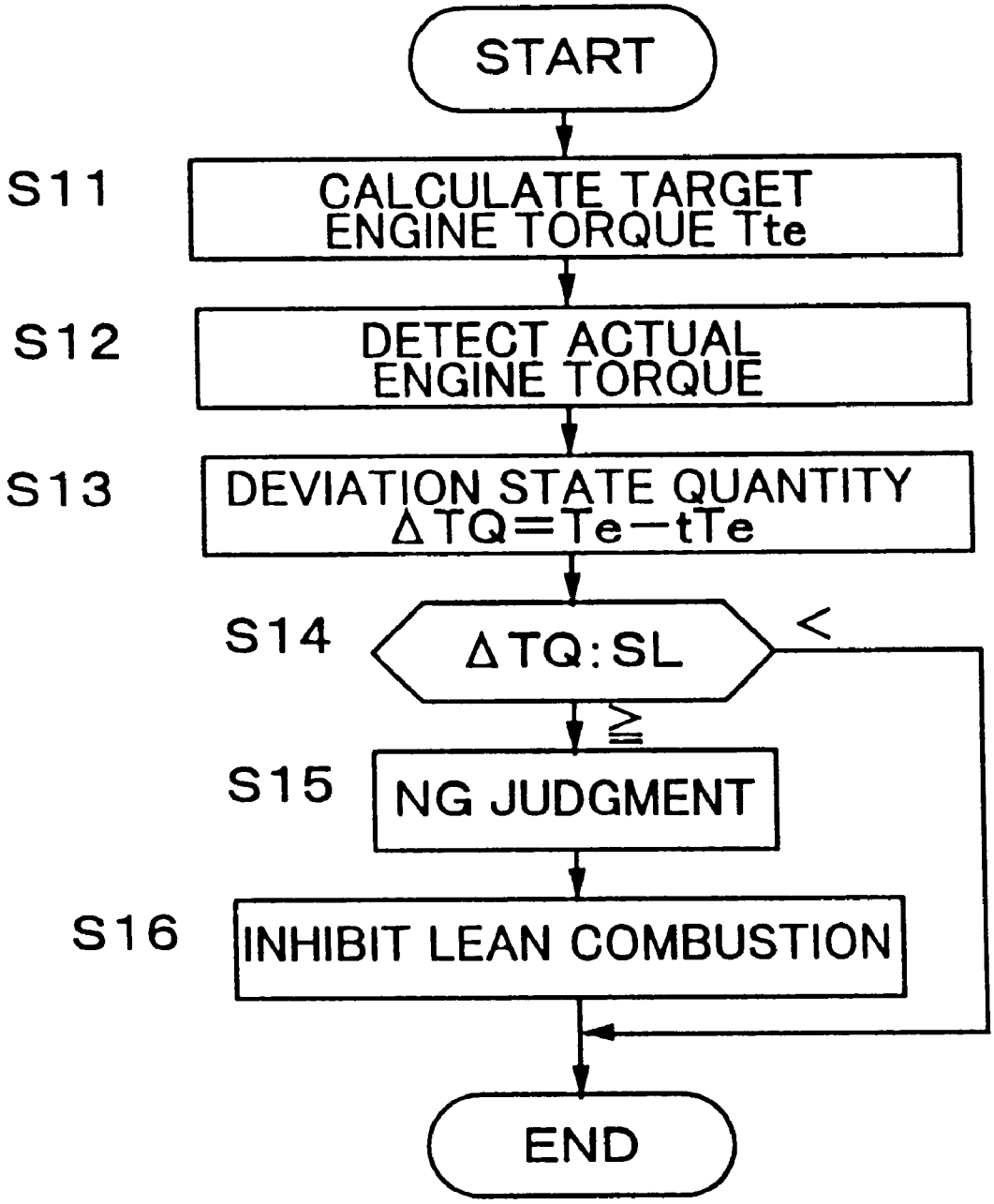
FIG. 4 is a flowchart of a routine for judging lean combustion inhibition.

Shown in FIG. 4 is a routine for judging lean combustion inhibition, which routine is executed at intervals of a predetermined period of time (such as 10 ms).

At step 11, there is calculated the target engine-torque tTe which is to be generated by the engine, based on the engine driving condition. This processing part corresponds to target engine-torque calculating device. Only, the actual calculation is performed by another routine, i.e., a subroutine of FIG. 5.

Figure 5:
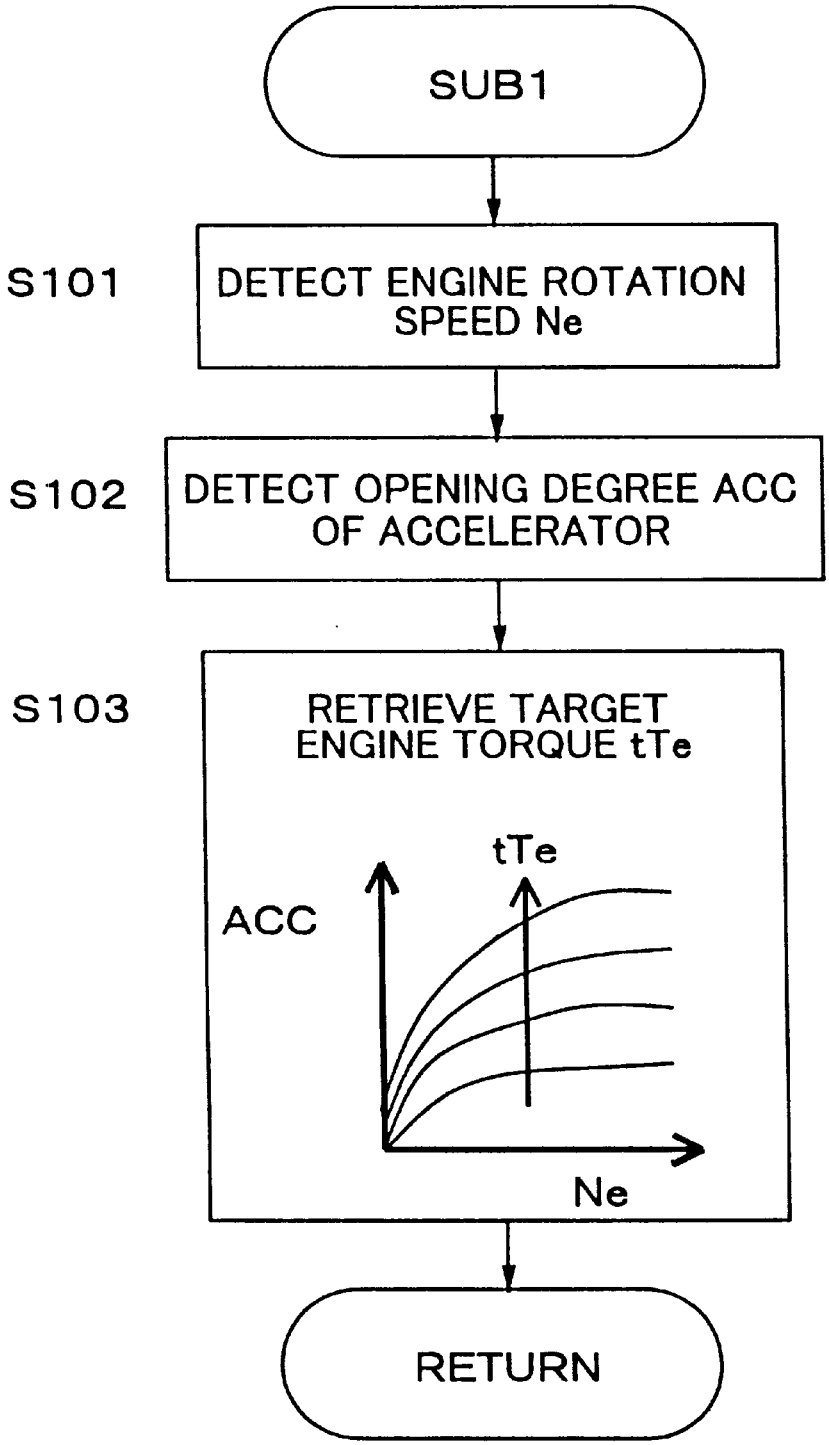
FIG. 5 is a flowchart of a routine for calculating a target engine-torque.

Referring to the subroutine of FIG. 5, the engine rotation speed Ne is detected at step 101, and the opening degree of accelerator ACC is detected at step 102. At step 103, there is referred to the map which is stored with the target engine-torque tTe which is to be generated by the engine, this torque tTe being previously set as a function of the parameters including engine rotation speed Ne and opening degree of accelerator ACC. Then, there is retrievingly obtained the target engine-torque tTe, based on the actual Ne and ACC.

At step 12, there is detected the actual engine-torque Te which is being actually generated by the engine. This processing part corresponds to actual engine-torque detecting device. Only, the actual detection is performed by another routine, i.e., a subroutine of FIG. 6 or that of FIG. 7.

Figure 6:
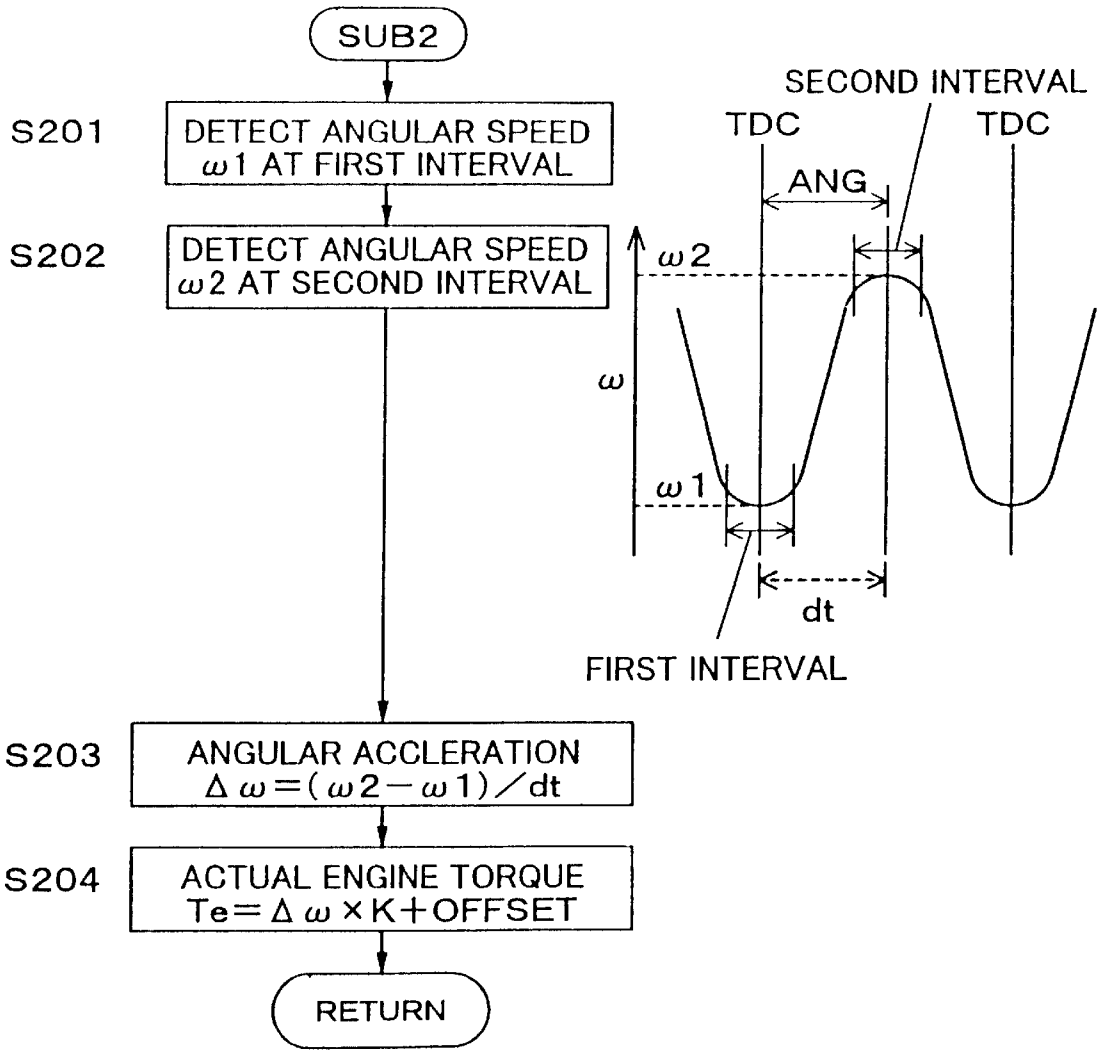
FIG. 6 is a flowchart of a routine for detecting an actual engine-torque.

With reference to the subroutine of FIG. 6, firstly at step 201, there is measured a rotational angular speed $\omega 1$ of the engine during a first interval having a crank angle range of 30° spanning before and after the top dead center TDC, respectively, while monitoring the crank angle based on the signals from the crank angle sensors 21, 22. Then, at step 202, there is measured a rotational angular speed $\omega 2$ of the engine during a second interval having a crank angle range of 30° spanning before and after such a point that is after the top dead center TDC by a predetermined crank angle ANG. In the above, the rotational angular speed is obtained by measuring the period of time from the starting point to the terminating point, in each of the intervals.

Then, at step 203, there is calculated a rotational angular acceleration $\Delta\omega=(\omega 2-\omega 1)/dt$ during a combustion stroke, based on the rotational angular speeds $\omega 1$ and $\omega 2$, wherein dt is a period of time (measured value) from the starting point to the terminating point of the predetermined crank angle ANG.

At step 204, there is calculated the actual engine-torque Te by the following equation, based on the rotational angular acceleration $\Delta\omega$ during the combustion stroke:

$$Te=\Delta\omega\times K+OFFSET;$$

wherein K is a conversion coefficient and OFFSET is an offset value (both constants).

Figure 7:
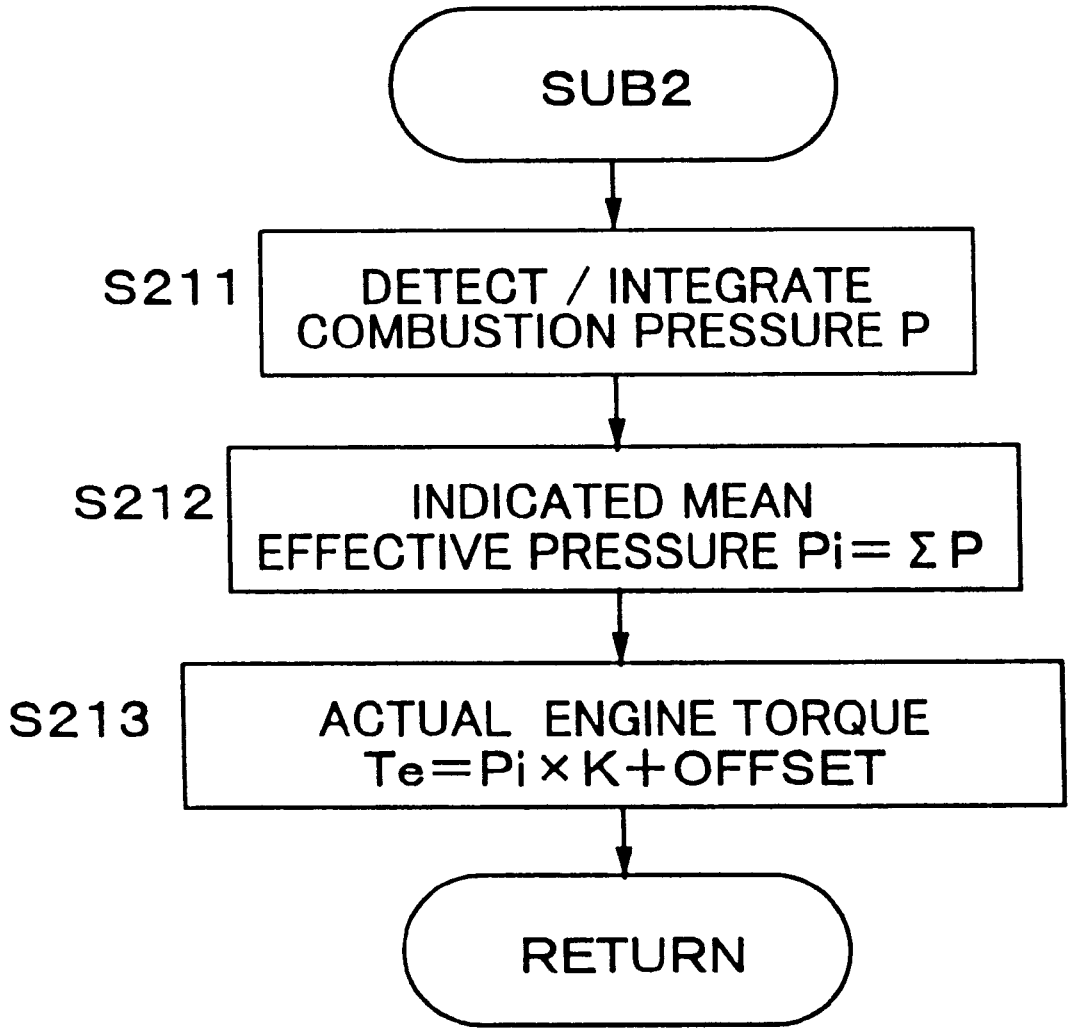
FIG. 7 is another embodiment of a flowchart of a routine for detecting an actual engine-torque.

With reference to the subroutine of FIG. 7, it is noted that a combustion pressure sensor (30 in FIG. 2) has been provided which comprises a piezoelectric element in a shape of mounting washer, at the threading mount portion of either of electromagnetic injection valve 6 or ignition plug 7. At step 211, during a period of time between a previously set integration starting crank angle and a previously set integration finishing crank angle, a combustion pressure P is read in by A/D converting a signal from the combustion pressure sensor at intervals of a predetermined sampling period of time, while monitoring the crank angle based on the signals from the crank angle sensors 21, 22. Concurrently, there is calculated an integrated value $\Sigma P=\Sigma P+P$, of the combustion pressure P. At step 212, the integrated value $\Sigma P$ during the period of time between the integration starting crank angle and the integration finishing crank angle, is detected as an indicated mean effective pressure Pi.

At step 213, there is calculated the actual engine-torque Te by the following equation, based on the indicated mean effective pressure Pi:

$$Te=Pi\times K+OFFSET;$$

wherein K is a conversion coefficient and OFFSET is an offset value (both constants).

Turning to FIG. 4, at step 13, as a deviation state quantity representing a deviation state between the target engine-torque tTe and the actual engine-torque Te, there is calculated a torque difference $\Delta TQ=Te-tTe$ (or $\Delta TQ=|Te-tTe|$) between the actual engine-torque Te and the target engine-torque tTe. This part corresponds to deviation state quantity calculating device.

At step 14, it is judged as to whether $\Delta TQ\geqq SL$ or not, by comparing the torque difference $\Delta TQ$ as the deviation state quantity, with a predetermined value (threshold value for judging abnormality) SL.

If the deviation state quantity is large, i.e., if $\Delta TQ\geqq SL$, there is assumed a possibility of deterioration of driveability, so that NG judgment is made at step 15, and the lean combustion is inhibited (lean combustion inhibition flag is set to '1') at step 16.

As a result, there are thereafter inhibited the homogeneous lean combustion control and the stratified lean combustion control at the combustion mode switching routine (steps 4 and 5) of FIG. 3, so that the homogeneous stoichiometric combustion control is performed (step 6).

Thus, the steps 14, 16 of FIG. 4 and 4, 5 of FIG. 3 cooperatively correspond to lean combustion inhibition device.

Meanwhile, if the deviation state quantity is small, i.e., if $\Delta TQ<SL$, this is a normal condition so that the routine of FIG. 4 is passed through to terminate the same.

There will be hereinafter described another embodiment of the present invention.

Figure 8:
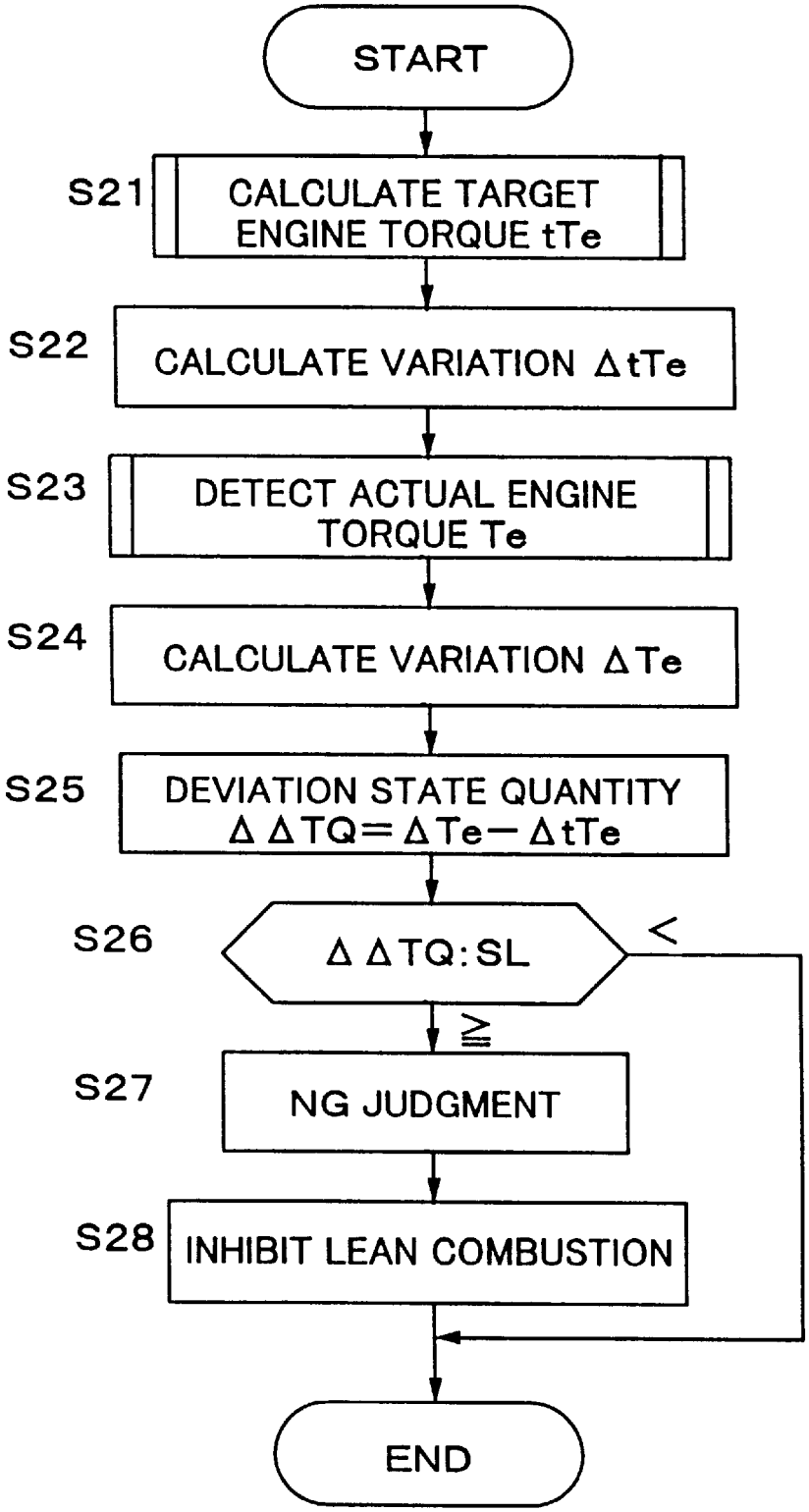
FIG. 8 is a flowchart of a routine for judging lean combustion inhibition according to another embodiment.

FIG. 8 shows another routine for judging lean combustion inhibition, to be executed instead of that of FIG. 4.

At step 21, there is calculated the target engine-torque tTe which is to be generated by the engine, based on the engine driving condition. This processing part corresponds to target engine-torque calculating device. Only, the actual calculation is performed by another routine, i.e., the subroutine of FIG. 5.

At step 22, there is calculated a variation of target engine-torque $\Delta tTe=tTe-tTeold$ (tTeold is a lastly calculated target engine-torque).

At step 23, there is detected the actual engine-torque Te which is being actually generated by the engine. This processing part corresponds to actual engine-torque detecting device. Only, the actual detection is performed by another routine, i.e., the subroutine of FIG. 6 or that of FIG. 7.

At step 24, there is calculated a variation of actual engine-torque $\Delta Te=Te-Teold$ (Teold is a lastly detected actual engine-torque).

At step 25, as a deviation state quantity representing a deviation state between the target engine-torque tTe and the actual engine-torque Te, there is calculated a torque variation difference $\Delta\Delta TQ=\Delta Te-\Delta tTe$ (or $\Delta\Delta TQ=|\Delta Te-\Delta tTe|$) between a variation of actual engine-torque $\Delta Te$ and a variation of target engine-torque $\Delta tTe$. This processing part corresponds to deviation state quantity calculating device.

At step 26, it is judged as to whether $\Delta\Delta TQ \geqq SL$ or not, by comparing the torque variation difference $\Delta\Delta TQ$ as the deviation state quantity, with a predetermined value (threshold value for judging abnormality) SL. It is noted that the predetermined value SL is to be set depending on an execution interval of this routine, such that the shorter the execution interval of the used device type is, the larger the value SL is set at.

If the deviation state quantity is large, i.e., if $\Delta\Delta TQ \geqq SL$, there is assumed a possibility of deterioration of driveability, so that NG judgment is made at step 27, and the lean combustion is inhibited (lean combustion inhibition flag is set to '1') at step 28.

As a result, there are thereafter inhibited the homogeneous lean combustion control and the stratified lean combustion control at the combustion mode switching routine (steps 4 and 5) of FIG. 3, so that the homogeneous stoichiometric combustion control is performed (step 6).

Thus, the steps 26, 28 of FIG. 8 and 4, 5 of FIG. 3 cooperatively correspond to lean combustion inhibition device.

Meanwhile, if the deviation state quantity is small, i.e., if $\Delta\Delta TQ<SL$, this is a normal condition so that the routine of FIG. 8 is passed through to terminate the same.

In this embodiment, the deviation state is quantified based on the difference between the variation of target engine-torque and the variation of actual engine-torque, so that the influence such as due to a machine variation and environment condition can be canceled, thereby improving diagnosis precision.

In the above, in case that the deviation state quantity is obtained as $Te-tTe$ or $\Delta Te-\Delta tTe$ and the thus obtained quantity is compared with a predetermined positive side value, it becomes possible to inhibit the lean combustion when the actual engine-torque is much larger than the target engine-torque so that the driveability is likely to be deteriorated. Further, in case that the deviation state quantity is obtained as $|Te-tTe|$ or $|\Delta Te-\Delta tTe|$ and the thus obtained quantity is compared with the predetermined positive side value, it becomes additionally possible to inhibit the lean combustion when the actual engine-torque is much smaller than the target engine-torque so that the driveability is also likely to be deteriorated.

According to the present invention as described above, there are detected: the target engine-torque which is to be generated by the engine; and the actual engine-torque which is being actually generated by the engine. Further, when the deviation state between the target engine-torque and the actual engine-torque is large, there is assumed or judged a possibility of deterioration of driveability, so that the lean combustion is inhibited. Thus, there can be effectively prevented deterioration of driveability due to lean combustion, so that the industrial applicability of the present invention is quite large and promising.

What we claimed are:

1. A control apparatus for a direct injection spark ignition type internal combustion engine, including a fuel injection valve for directly injecting fuel into a combustion chamber of the engine, and combustion mode switching control means for controlling switching of a combustion mode of the engine at least between a stoichiometric air-fuel ratio and lean combustion at lean air-fuel ratio, corresponding to an engine driving condition, said apparatus comprising:

target-engine-torque calculating means for calculating a target engine-torque which is to be generated by the engine, based on the engine driving condition;

actual engine-torque detecting means for detecting an actual engine-torque which is being actually generated by the engine;

deviation state quantity calculating means for calculating a deviation state quantity which represents a deviation state between said target engine-torque and said actual engine-torque; and lean combustion inhibition means for inhibiting said lean combustion when said deviation state quantity is equal to or larger than a predetermined value.

2. A control apparatus for a direct injection spark ignition type internal combustion engine of claim 1, wherein said target engine-torque calculating means calculates said target engine-torque, based on an engine rotation speed and an opening degree of accelerator.

3. A control apparatus for a direct injection spark ignition type internal combustion engine of claim 1, wherein said actual engine-torque detecting means calculates the actual engine-torque, based on a rotational angular acceleration during a combustion stroke of said engine.

4. A control apparatus for a direct injection spark ignition type internal combustion engine of claim 1, wherein said actual engine-torque detecting means calculates the actual engine-torque, based on a combustion pressure of said engine.

5. A control apparatus for a direct injection spark ignition type internal combustion engine of claim 1, wherein said deviation state quantity calculating means calculates the deviation state quantity, as a difference between said target engine-torque and the actual engine-torque.

6. A control apparatus for a direct injection spark ignition type internal combustion engine of claim 1, wherein said deviation state quantity calculating means calculates the deviation state quantity, as a difference between a variation of said target engine-torque and a variation of the actual engine-torque.

7. A control apparatus for a direct injection spark ignition type internal combustion engine of claim 1, wherein said combustion mode switching control means switchingly controls said combustion mode of said engine corresponding to the engine driving condition, at least between: homogeneous stoichiometric combustion at said stoichiometric air-fuel ratio in which fuel is injected during an intake stroke; homogeneous lean combustion at said lean air-fuel ratio in which fuel is injected during the intake stroke; and stratified lean combustion at said lean air-fuel ratio in which fuel is injected during a compression stroke; and said lean combustion inhibition means inhibits the homogeneous lean combustion and the stratified lean combustion, when said deviation state quantity is equal to or larger than a predetermined value.

8. A control apparatus for a direct injection spark ignition type internal combustion engine, including a fuel injection valve for directly injecting fuel into a combustion chamber of the engine, and combustion mode switching control device for controlling switching of a combustion mode of the engine at least between a stoichiometric air-fuel ratio and lean combustion at lean air-fuel ratio, corresponding to an engine driving condition, said apparatus comprising:

a target-engine-torque calculating device that calculates a target engine-torque to be generated by the engine, based on the engine driving condition;

an actual engine-torque detecting device that detects an actual engine-torque actually generated by the engine;

a deviation state quantity calculating device that calculates a deviation state quantity representing a deviation state between said target engine-torque and said actual engine-torque; and a lean combustion inhibition device that inhibits said lean combustion when said deviation state quantity is equal to or larger than a predetermined value.

* * * * *